US007579586B2

(12) United States Patent
Bowdler et al.

(10) Patent No.: US 7,579,586 B2
(45) Date of Patent: Aug. 25, 2009

(54) ION SELECTOR

(75) Inventors: Andrew Bowdler, Walsall (GB); Ian Brookhouse, Cheshire (GB); Emmanuel Raptakis, Cheshire (GB)

(73) Assignee: Kratos Analytical Limited, Greater Manchester (GB)

( * ) Notice: Subject to any disclaimer, the term of this patent is extended or adjusted under 35 U.S.C. 154(b) by 862 days.

(21) Appl. No.: 11/104,674

(22) Filed: Apr. 13, 2005

(65) Prior Publication Data

US 2008/0230688 A1 Sep. 25, 2008

(30) Foreign Application Priority Data

Apr. 13, 2004 (GB) ..... 0408235

(51) Int. Cl.
*H01J 49/00* (2006.01)

(52) U.S. Cl. ..... 250/287; 250/286; 250/282; 250/281

(58) Field of Classification Search ..... 250/282, 250/287, 281, 286; 95/57, 78, 79, 80; 96/15; 73/23.2, 31.07
See application file for complete search history.

(56) References Cited

U.S. PATENT DOCUMENTS 4,633,083 A * 12/1986 Knorr et al. ..... 250/282
6,348,688 B1 2/2002 Vestal
6,489,610 B1 * 12/2002 Barofsky et al. ..... 250/287
2004/0144918 A1 * 7/2004 Zare et al. ..... 250/287

FOREIGN PATENT DOCUMENTS

GB 2 076 588 A 12/1981
WO WO 98/33203 7/1998

OTHER PUBLICATIONS

Kimmel et al., Novel method for the production of finely spaced Bradbury-Nielson gates, Dec. 2001, Review of Scientific Instruments, vol. 72 Num 12, pp. 4354-4357.*

* cited by examiner

*Primary Examiner*—Jack I Berman
*Assistant Examiner*—Hanway Chang
(74) *Attorney, Agent, or Firm*—Squire, Sanders & Dempsey, L.L.P.

(57) ABSTRACT

The present invention provides an ion selector gate having a first deflection zone 32 and a second deflection zone 34 spaced from the first deflection zone, wherein in use, a single low voltage trigger pulse generated by timing electronics with a width in time equal to or proportional to the width of the gate pulse $T_{gd}$ and at a position in time that the ion gate is required to be open to allow through ions of the correct nominal mass. The trigger pulse may go through an inverter 38 and then to two high voltage pulsers 40 and 42. The high voltage pulsers each produce simultaneously a signal that switches to ground and back on again from the same amplitude high voltage but the opposite polarity. The outputs of the high voltage pulsers are connected to interleaved wires of both ion gates 32, 34. Thus, the high voltage pulsers are applied simultaneously to both ion gates.

34 Claims, 6 Drawing Sheets

ION SELECTOR

The present invention is concerned with ion selector apparatus for mass spectrometers and methods of selecting ions. In particular it is concerned with ion selector apparatus for use in time of flight mass spectrometers (TOF-MS), especially TOF MS/MS spectrometers.

One of the most widely used types of mass spectrometer is the time of flight (TOF) mass spectrometer. TOF mass spectrometers separate ions by virtue of their different flight times over a known distance.

Generally, a time of flight mass spectrometer has an ion source and a detector. The path taken by the ions travelling between the ion source and the detector is known as the ion flight path.

Typically, a collection of ions is generated from a sample in the ion source, for example by laser desorption. The ions are accelerated to a selected kinetic energy and enter a drift region where, because each ion's kinetic energy is equal to $\frac{1}{2}mv^2$ and has the same value for each ion, ions of different mass will have a different velocity.

Ions having a relatively high velocity will arrive at a detector in a shorter time than ions having a relatively low velocity. In this way it is possible to correlate flight time and molecular weight so that on analysing an unknown compound, it is possible to assign weights to the unknown peaks on the basis of the flight time for the peak.

This enables ions of different mass to be identified by a detector.

In a development of the TOF technique, the first mass spectrum (MS) can be followed by a second stage of MS where fragment ions of the original ions are analysed. This MS/MS can be carried out sequentially in two linked TOF mass spectrometers, known as tandem TOF, or in a single TOF mass spectrometer where the mass spectrometer is provided with an ion reflector to separate out the fragment ions by virtue of their different energies. TOF MS/MS permits the analysis of daughter ions or fragment ions formed as a result of fragmentation of the original ions.

In TOF MS/MS meta-stable ions, generated in the ion source, enter the drift region where they break into fragments in a process known as post-source decay. Post-source decay may occur automatically or it can be induced by a laser or within a collision cell to produce fragment ions. These fragment or daughter ions are useful for determining the structure of the sample from which the meta-stable ions are generated. For example, in the case of a peptide sample, these daughter ions are related to the amino acid composition of the sample molecule and can therefore be used to deduce sequence information.

In order to analyse the daughter fragments they must be unambiguously assigned to the precursor ion formed in the ion source. This is normally achieved by placing an ion selector gate, also known as a timed ion gate, somewhere between the ion source and the detector.

An ion selector gate can selectively block transmission of ions from the ion source to the detector. This is typically achieved by providing two parallel plates, one each side of the ion flight path and selectively applying a potential between the plates to generate an electrostatic field to selectively open and close the gate.

Thus, to "close" the gate, a potential difference is applied between the plates to generate a deflecting field such that ions are deflected away from their original flight path and hence away from the detector. Conversely, when the ion gate is in the "open" configuration, the potential difference is grounded, so that ions can continue along their original flight path to the detector.

The time of arrival of ions at the ion gate is dictated by their velocity, and hence their mass. Thus, an ion selector gate can be opened and closed at predetermined times to selectively allow ions of interest to continue through the drift region, where fragmentation can occur. In this way, any daughter ions reaching the detector can be unambiguously assigned to the ions of interest.

The mass resolution, R, of an ion selection gate will determine how close together in mass two ions can be and still be separated for individual MS/MS. For example, a simple plate ion deflector might have a mass resolution of 20 which means that the minimum mass separation is 50 Da at a nominal ion mass of 1000 Da.

The mass resolution thus provides a measure of how precisely an ion gate is able to select a desired set of ions. A high mass resolution indicates that an ion gate is able to select a narrow distribution of ions, i.e. a group of ions having only a small variation in mass. A relatively low mass resolution indicates that an ion gate is only capable of selecting a wider distribution of ions, i.e. a group of ions having a larger variation in mass.

Previous attempts at achieving high mass resolution have involved maximising the ratio of the distance of the ion gate from the ion source, $L_g$, to the effective length of the ion gate, $l_g$, which ratio represents a fundamental limit of mass resolution, i.e. $R=m/\delta m=L_g/l_g$.

In practice, this can be achieved either by moving the gate a long way from the source or making the gate very short. The distance from the source is limited by the physical size of the instrument coupled with the need for sufficient deflection for the ions to miss the detector.

The length of the ion gate is limited by the physical size of the ion gate and the nature of the electrostatic field generated. For example, a gate that generates a large electrostatic field that extends some way beyond the physical extremities of the gate will have a larger effective length and may deflect ions even when outside the physical extremities of the gate.

The speed of the pulsing electronics used to open and close the gate will also affect the effective length of the ion gate and hence the mass resolution.

In other words, the speed with which an ion gate can be switched between open and closed states and the minimum length of time the gate can be kept in an open or closed position, will affect the mass resolution.

The dependency of mass resolution R on the length of the switching pulse applied to the gate, i.e. the minimum length of time a gate can remain open or closed, can be derived as follows:

The time of the pulse being switched on and the first mass, M, is allowed through the ion gate, is given by;

$$T_{on}=kL_gM^{1/2}$$

where k is a constant of the mass spectrometer (which depends on the extraction potential and source ion optics voltages).

The time of the pulse being switched off and the last mass, M+δM being allowed through the ion gate is given by;

$$T_{off}=kL_g(M+\delta M)^{1/2}$$

The width of the gate pulse, $T_{gs}$ is simply $T_{off}-T_{on}$ which gives;

$$T_{gs}=kL_gM^{1/2}[(1+\delta M/M)^{1/2}-1]$$

For $\delta M/M<<1$, expanding this leads to;

$$T_{gs}=T_{on}(\delta M/2M)$$

Which gives the familiar equation for mass resolution, in terms of the ion gate;

$$M/\delta m=T_{on}/2T_{gs}$$

Thus, a very small pulse width $T_{gs}$ is needed to generate a high mass resolution, M/δm.

The performance of the ion selector is also related to the ion gate's ability to provide sufficient deflection.

Typically, the voltage applied to a plate deflector of the sort described above is such that an ion must travel the full length of the gate for complete deflection to occur, so that it misses the detector. Thus, a longer deflection gate (in the direction of the ion flight path) may be used to compensate for a lower applied voltage, and vice versa.

Wire ion gates, also known as Bradbury-Nielson gates, have also been used in mass spectrometers. These gates comprise a plurality of parallel wires extending across the ion flight path. Alternate wires are connected to positive and negative potentials, respectively. Typically, the ion gate is kept in a closed state until an ion of interest approaches at which point the gate is switched to an open state.

Since the wire gate has a very small effective length, for example 2 to 3 mm, the ion of interest passes through the gate rapidly and, in order to prevent other ions from passing through the gate it is desirable to be able to switch the gate to a closed state as rapidly as possible.

However, it is very difficult to produce a pulse signal that is sufficiently short to take advantage of the short effective length of the wire ion gate. The pulsing electronics necessary to generate a very short switching pulse, for example 10 ns to 30 ns, are complicated and expensive.

The operation of a known wire ion gate is illustrated schematically in FIGS. 1*a* to 1*c*. A wire ion gate 2 having a plurality of parallel wires of 50 μm diameter and 500 μm spacing, is located in the ion flight path of a TOF mass spectrometer, between the ion source 4 and detector 6. Alternate wires 8, 10 are electrically isolated from one another so that a positive and negative voltage can be applied to alternate wires.

FIG. 1*a* shows the gate in a closed state in which a voltage is applied to the wires to create an electrostatic field which deflects ions 12 that pass through the gate.

FIG. 1*b* shows the gate in an open state, wherein the wires are grounded so that an ion of interest 14 can pass through the gate undeflected and hence reach the detector 6.

FIG. 1*c* illustrates schematically the switching pulse that is applied to the gate in order to switch the gate between open and closed states. Initially the gate is held in a closed state 16 such that ions 12 are deflected. After a predetermined time $T_{on}$ has passed, a switching pulse 18 is applied to the gate to open the gate and ions of interest 14 can pass through undeflected. The switching pulse has a pulse width of $T_{gs}$ and so after time $T_{gs}$, the gate returns to a closed state.

A hybrid of the plate deflector and wire ion gate has been described in U.S. Pat. No. 6,489,610 and U.S. Pat. No. 5,986,258. Both these patents describe an array of thin parallel strips that extend across the ion flight path so as to provide a series of channels through which ions may pass. The parallel strips are connected to a voltage source such that alternating strips can be provided with a positive and negative voltage respectively.

In U.S. Pat. No. 5,986,258 a single strip deflector, or "extended Bradbury Nielson gate" is used to select ions in much the same way as the Bradbury Nielson gate.

Ion selector gates having two separate gates are also known. For example, two pairs of plate deflectors may be placed one after the other along the ion flight path and a switching pulse sequentially applied to the first gate and then to the second gate. Some improvement in mass resolution may be achieved with this approach, but dual plate deflectors have not provided high mass resolution.

In U.S. Pat. No. 6,489,610 two sets of strip deflectors are used in a dual gate arrangement. The strip gates are operated so as to deflect an ion of interest initially in a first direction and then subsequently in a second, opposite, direction. In this way, the ion ends up on a course parallel to its original trajectory.

In this dual gate arrangement, two strip gates are spaced apart along the ion flight path. The first and second strip gates have opposite polarities and so, when closed, produce deflections in opposite directions.

The first gate is initially maintained in a closed state, and causes complete deflection in a first direction of any ion passing all the way through the gate. The second gate is initially open.

When an ion of interest approaches the first gate, the gate is opened and the decaying electrostatic field produced during the switching process causes partial deflection of the ion of interest in the first direction. The partially deflected ion exits the first gate and travels towards the (still open) second gate.

At a predetermined time that coincides with the ion of interest arriving at the second gate, the second gate is switched to a closed state, but the polarity or direction of the electrostatic field is opposite to that of the first gate. The growing electric field caused during the switching of the second gate causes the ion of interest to be partially deflected in a second direction, opposite to the first.

The net result of the two partial deflections in opposite directions is that the ion of interest continues towards the detector on a trajectory parallel to its original path. Ions arriving at the gate either before or after the ion of interest will experience a net deflection in either the first or second direction such that their trajectories cause them to miss the detector. Thus, ion selection is achieved by applying switching pulses sequentially to the first and then the second gate.

The present inventors have recognised a number of drawbacks associated with existing methods of selecting ions for TOF-MS.

Where a single ion gate is used, for example a parallel wire or Bradbury Nielson gate, the mass resolution is limited by the length of the switching pulse that is applied to the gate, i.e. the minimum length of time the gate can be maintained in an open or closed state, and in particular the open state. It is very difficult and hence expensive to generate very short switching pulses, e.g. 10 ns to 20 ns. Thus, it is difficult to take advantage of the short physical length of e.g. wire ion gates.

Strip deflectors have a smaller capacitance than plate deflectors but they require a higher operating voltage because the length of the gate is typically much shorter and so complete deflection of the ion must occur over a shorter distance. In any case, their performance is still limited by the length of the switching pulse applied to the gate.

The present invention seeks to address some or all of the drawbacks associated with existing ion selector methods and apparatus. Furthermore, the present invention addresses the problem of providing high mass resolution.

At its broadest the present invention proposes that high mass resolution may be achieved by providing an ion selector having two ion deflection zones that are switched between closed and open states simultaneously.

In a first aspect, the present invention provides a method of ion selection in a time of flight mass spectrometer having an ion source, a detector, and an ion selector gate having first and second ion deflection zones located in series along an ion flight path between the ion source and the detector, the method including the step of simultaneously applying a switching pulse to both ion deflection zones, to open or close both deflection zones simultaneously, wherein when a deflection zone is closed it deflects ions so that they do not reach the detector.

This method preferably provides high mass resolution by applying a switching pulse to two deflection zones at the same time.

An advantage of the present invention is that high mass resolution can be achieved without having to use complicated and expensive electronic switching circuitry to generate very short switching pulses. In other words, the need for switching pulses having very narrow pulse widths is removed when the method of the present invention is employed.

The present invention allows a relatively long switching pulse, for example 80 ns to 200 ns, to be used whilst still providing high mass resolution. This is in contrast to previous methods for selecting ions in which a relatively long switching pulse, for example 80 ns to 200 ns, represents a limitation in the mass resolution.

By using two deflection zones and preferably applying the same switching pulse to both deflection zones, the spatial volume of ions that are selected by the gate can be reduced. This is achieved because the start point for the spatial distribution is defined by the opening of the first deflection zone and the end point is defined by the closing of the second deflection zone.

Suitably, the method includes the steps of setting both ion deflection zones to a closed state, simultaneously applying a switching pulse to both zones to open and then close them.

In this way, ions travelling from the ion source to the detector along the ion flight path will initially be completely deflected by the first ion deflection zone, until a time at which the deflection zones are opened simultaneously, at which point the ions can pass through the first zone and then the second zone. Ions continue to pass through both zones until the zones close, at which point any ions that have not yet passed through the second zone will be deflected as they pass through the closed second zone. In other words, any ions caught between the two deflection zones when the deflection zones switch back to a closed state will not be detected.

Thus, preferably only ions that have passed without significant deflection through both the first and second deflection zones will be selected.

Accordingly, the total number of ions passing the ion selection gate without significant deflection (and hence being "selected" by the gate) is the number of ions passing the first deflection zone during the time the deflection zones are in an open state, minus the number of ions caught between the deflection zones at the time when the deflection zones switch back to a closed state.

Typically, the instrument is operated such that the "on time" of the ion selector gate is when the lowest mass ion of interest reaches the first deflection zone and the "off time" is when the highest mass ion of interest reaches the second deflection zone. Extra time is required for the higher selected mass to travel from the first to the second deflection zone so that an advantage of the present invention is that the pulse width required for a particular mass resolution is longer than that for a single deflection zone.

In this way, the present invention preferably combines the use of two deflection zones and a single switching pulse.

Preferably, the present invention allows the mass resolution to be adjusted by altering the separation between the two deflection zones. Preferably, the mass resolution may be adjusted by altering the length of the signal pulse applied to the zones. Suitably, the method includes the step of selecting a pulse width before applying the switching pulse to the two deflection zones.

Suitably, the duration of the switching pulse and/or the separation between the two deflection zones may be adjusted to optimise mass resolution. Thus, if a longer switching pulse width is used, for example to simplify the switching electronics, then this can be compensated for by increasing the separation of the two deflection zones. Preferably, this is another advantage of the present invention.

Suitably, the mass spectrometer may include two or more ion deflection zones. For example, three, four or five deflection zones may be provided. Preferably, two deflection zones are provided. Where more than two deflection zones are provided, preferably the method includes the step of simultaneously applying a switching pulse to all the deflection zones.

The step of simultaneously applying a switching pulse to both deflection zones may be achieved by applying the same switching pulse to both deflection zones or by applying different switching pulses to respective deflection zones at the same time. In the case where different switching pulses are applied to the respective deflection zones at the same time, preferably a single control circuit controls the application of the switching pulses to the deflection zones.

The term "simultaneously" as used herein in relation to the application of a switching pulse to the two deflection zones includes negligible or very small differences in the actual time at which each deflection zone experiences the switching pulse, such differences arising, for example, as a result of differences in electron transit time. In other words, in achieving the aims of the present invention, negligible or insignificant differences are included in the term "simultaneously applying a switching pulse to both deflection zones".

Preferably, however, the same switching pulse is applied to both zones. Preferably, only a single pulse generator is used and this results in cost savings and simplifies the electronic circuitry.

The two ion deflection zones may be provided within a single extended ion gate or by two discrete ion gates.

In the case where the two ion deflection zones are provided by a single extended ion gate, each deflection zone, when in a closed state, provides complete deflection of any ions passing through it. In other words, an ion passing through one of the deflection zones in a closed state will not reach the detector and so will not be detected.

Complete deflection in each zone may be achieved, for example, by ensuring that the single extended gate has sufficient length to provide complete deflection in each deflection zone. Additionally or alternatively, the voltage supplied to the single extended ion gate is sufficient to cause complete deflection in both deflection zones. For example, an extended gate may have a length of about 3 mm and an applied voltage sufficient to cause complete deflection in both the first half and in the second half of the extended ion gate. Preferably, a single extended ion gate has a length of about 3 to 12 mm, more preferably 5 to 9 mm.

In the case where the two ion deflection zones are provided by a single extended ion gate, it is preferred that the single extended ion gate is a strip deflector, having a plurality of parallel conductive strips that, in use, extend across the ion flight path to provide a plurality of channels through which the ions can pass.

However, it is preferred that the two deflection zones are provided by two discrete ion gates.

In this case, preferably the gates are separated by about 1 to 20 mm, more preferably about 1 to 10 mm, and even more preferably by about 2 to 6 mm. A particularly preferred separation is about 2 to 5 mm, especially about 4 mm.

Preferably, the two discrete ion gates are arranged to provide orthogonal deflection fields in use. Typically, the discrete ion gates are arranged approximately at right angles. Other field orientations are possible but it is preferred that the deflection fields are at an angle of at least 20°, preferably at least 40°, more preferably at least 60° and most preferably at least 80°.

The deflection zones may be provided by wire ion gates or by strip deflectors.

Preferably, each of the deflection zones is provided by a wire ion gate, also known as a Bradbury Nielson gate as discussed previously. Preferably, the wire ion gate has a set of parallel wires each having a diameter of about 10 μm to 100 μm, more preferably about 30 μm to 70 μm, and most preferably about 45 μm to 55 μm.

Suitably, the wires are spaced apart by about 200 μm to 1000 μm, preferably about 300 μm to 700 μm, more preferably about 400 μm to 600 μm and most preferably about 480 μm to 520 μm.

Wire ion gates are preferred because they have a short physical length, so that when used in accordance with the present invention, high mass resolution can be achieved. Indeed, preferably the present invention makes it possible to take advantage of the high theoretical mass resolution achievable with such ion gates.

Preferably, an advantage of using wire ion gates in the present invention is that they have good edge resolution so that when used in accordance with the present invention, high mass resolution can be achieved without the need for very narrow pulsewidths.

Edge resolution depends on the distance from the edge of the gate to where the field is negligible. Wire ion gates, as described have alternating polarity on closely spaced wires. The electric field from such a gate falls to zero much more rapidly than that from the dipole field produced by two parallel plates.

Typically the two wire ion gates, e.g. Bradbury Nielsen gates, each have a set of parallel wires and the two sets of parallel wires are parallel with respect to each other. Alternatively, the parallel wires in a first ion gate may be non-parallel with the parallel wires in a second wire ion gate. Preferably the parallel wires in the first ion gate are "crossed" with respect to the orientation of the parallel wires in the second ion gate. In other words, they are preferably aligned such that the longitudinal axis of a wire in the first ion gate forms an angle with the longitudinal axis of a wire in the second ion gate. Preferably the angle is at least 10°, more preferably at least 45°, and most preferably at least 80°. A particularly preferred angle is about 90°. A "crossed" (non-parallel) arrangement within the ion gate has been found to provide improved selection of desired ions.

Other angles are possible, for example any angle between 0° and 90°, for example at least 20°, preferably at least 40°, more preferably at least 60° and most preferably 80°.

In another aspect, the present invention provides an ion selector apparatus for use in a mass spectrometer having an ion source and a detector, the ion selector apparatus having a first deflection zone, a second deflection zone, and control means, wherein in use the first and second deflection zones are located between the ion source and the detector, and the first and second deflection zones are simultaneously switchable by the control means between a closed state, in which each deflection zone deflects ions so that they are not detected and an open state in which ions can pass through the deflection zones to the detector.

Preferably, in use, the first and second deflection zones are arranged in series along the ion flight path so that ions pass through the first deflection zone and then through the second deflection zone.

Suitably, the first and second deflection zones are simultaneously switchable by the control means from an open to a closed state. Preferably, the two deflection zones are simultaneously switchable by the control means from a closed state to an open state and then back to a closed state.

Preferably therefore, in use the ion selector apparatus is capable of selecting a spatial distribution of ions whose limits are defined by the leading edge of ions that approach the first deflection zone as it opens and the trailing edge of ions that exit the second deflection zone as the deflection zones are closed.

Preferably, the apparatus of the present invention provides improved mass resolution when compared to dual ion gates operating with sequential switching pulses.

The features and advantages of the method of the present invention described above also apply to the apparatus of the present invention described here. Furthermore the features and advantages of the apparatus also apply to the other aspects of the invention.

Preferably, the control means includes a switching circuit for simultaneously applying a switching pulse to both deflector zones.

Preferably, the switching circuit provides a switching pulse having a pulse width of about 30 ns to 500 ns, more preferably about 40 ns to 200 ns, and most preferably about 50 ns to 150 ns.

The two deflection zones may be electrically connected such that they share the same voltage supply. Alternatively, the voltage applied to each deflection zone may be supplied by different voltage supplies. In the latter case the deflection zones are suitably provided with a switching circuit to simultaneously apply the separate voltages to the two deflection zones.

Preferably, the switching circuit includes a high voltage pulse generator and a trigger pulse generator for generating a trigger pulse to drive the high voltage pulse generator.

Preferably, the switching circuit includes two high voltage pulse generators. Suitably, a trigger pulse generator simultaneously supplies a trigger pulse to both high voltage pulse generators.

In use, the voltage applied to the deflection zones causes deflection of any ions passing through either of the deflection zones when they are in a closed state, so that the ions are not detected.

Suitably, the voltage applied to each deflection zone is about 200 V to 2 kV, more preferably about 300 V to 1 kV and most preferably about 400 V to 800V. A particularly preferred voltage is about 500 V.

Suitably, one high voltage pulse generator provides a negative voltage and the other high voltage pulse generator provides a positive voltage.

Preferably, the polarity or direction of the electrostatic field produced by the deflection zones is the same for each deflection zone.

The two deflection zones may be discrete, in the sense that they are non-continuous, or they may exist as part of a continuous or extended gate arrangement, as discussed above.

Thus, the ion selector apparatus of the present invention may be provided by, for example, two wire ion gates spaced apart or alternatively, by an extended strip gate arrangement, for example.

In the case where the two deflection zones are provided by a continuous extended gate, it is preferred that the extended gate is an extended strip gate. Preferably, the strip gate has a length, measured in the direction of the ion flight path, of about 3 mm to 8 mm, more preferably, about 4 mm to 6 mm. Suitably, as noted above, the voltage applied to the deflection zones in use causes deflection of the ions when they pass through either zone so that they are not detected.

In the case where the deflection zones are provided by an extended strip gate, the first deflection zone may be provided by the first half of the extended strip gate, for example the first 3 mm of an extended strip gate having a length of 6 mm, and the second deflection zone provided by the second half of the extended strip gate, for example the last 3 mm of a 6 mm extended strip gate.

However, it is preferred that the ion selector apparatus includes two discrete deflection zones.

In a preferred arrangement, the deflection zones are wire ion gates of the sort described above, for example Bradbury Nielson gates.

It is particularly preferred that the two deflection zones are provided by two ion gates and that the apparatus includes a switching circuit for simultaneously applying a switching pulse to both wire ion gates.

This arrangement has the advantage that known wire ion gates such as Bradbury Neilson gates can be used in accordance with the present invention to provide high mass resolution.

In a further aspect, the present invention provides an ion selector gate having a first deflection zone and a second deflection zone spaced from the first deflection zone, wherein the first and second deflection zones are electrically connected such that a voltage applied to the first deflection zone is also applied to the second deflection zone.

Thus, preferably, two discrete deflection zones are connected so that a single voltage source can be used to drive both gates.

Preferably the two discrete ion gates are arranged at right angles to provide orthogonal deflection fields in use.

In a preferred arrangement the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate.

Preferably, a single wire provides alternate parallel wires in the first wire ion gate and alternate wires in the second wire ion gate.

Preferably, the ion selector gate includes at least one insulating post for supporting the parallel wires, and first and second conducting posts, respective conducting post being connected in use to a positive and a negative voltage supply.

Preferably, alternate parallel wires of the first wire ion gate and alternate parallel wires of the second wire ion gate are connected to the first conducting post.

Preferably, such wires are provided by a single continuous wire.

Alternatively or additionally, the other alternate parallel wires of the first wire ion gate and the other alternate parallel wires of the second wire ion gate are connected to the second conducting post. Preferably, such wires are provided by a single continuous wire.

In another preferred arrangement, the two deflection zones are provided by two strip deflectors and the apparatus includes a switching circuit for simultaneously applying a switching pulse to both strip deflectors.

In a further aspect, the present invention provides a mass spectrometer including an ion selector apparatus as described above.

In another aspect, the present invention provides a mass spectrometer including an ion selector gate as described above.

Where appropriate, the following features and advantages apply to both aspects of the invention above relating to mass spectrometers.

Typically, the mass spectrometer has an ion source and a detector and an ion flight path therebetween. Preferably, the two deflection zones of the ion selector apparatus are located in series between the ion source and detector, along the ion flight path.

Preferably, the mass spectrometer is a TOF mass spectrometer, more preferably a TOF MS/MS spectrometer. In particularly preferred embodiments the mass spectrometer includes a reflectron and the deflection zones of the ion selector apparatus are located between the ion source and the reflectron.

The invention will now be described by way of example only with reference to the accompanying figures in which:

FIGS. 1*a* to 1*c* show schematically the operation of an ion selector gate of the prior art, as described above;

Figure 4A:
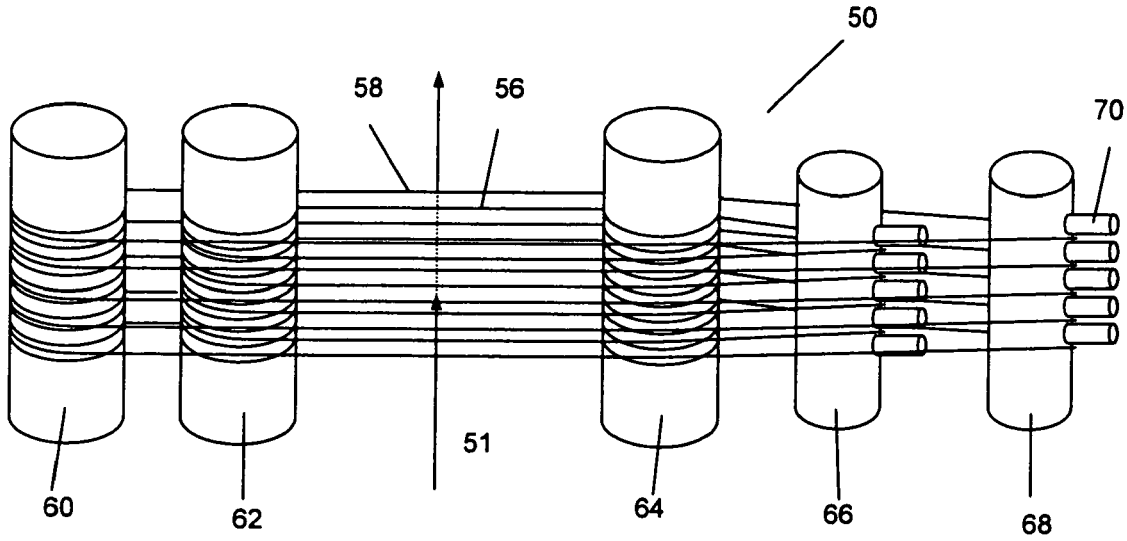
Figure 4B:
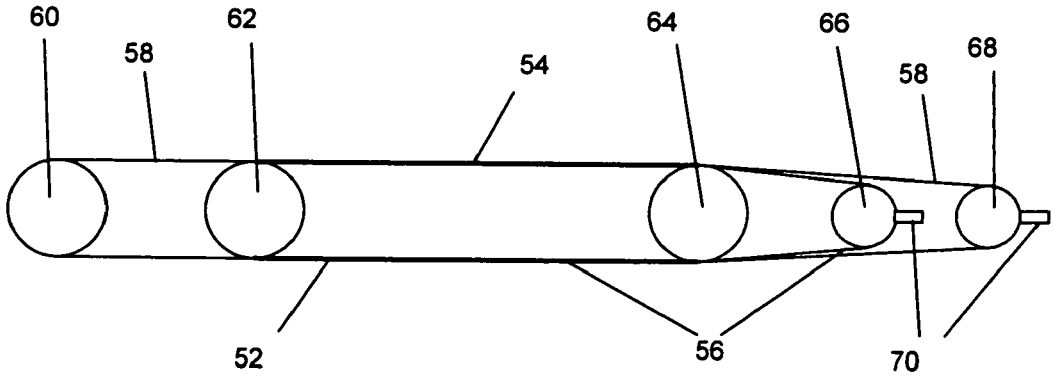
Figure 5:
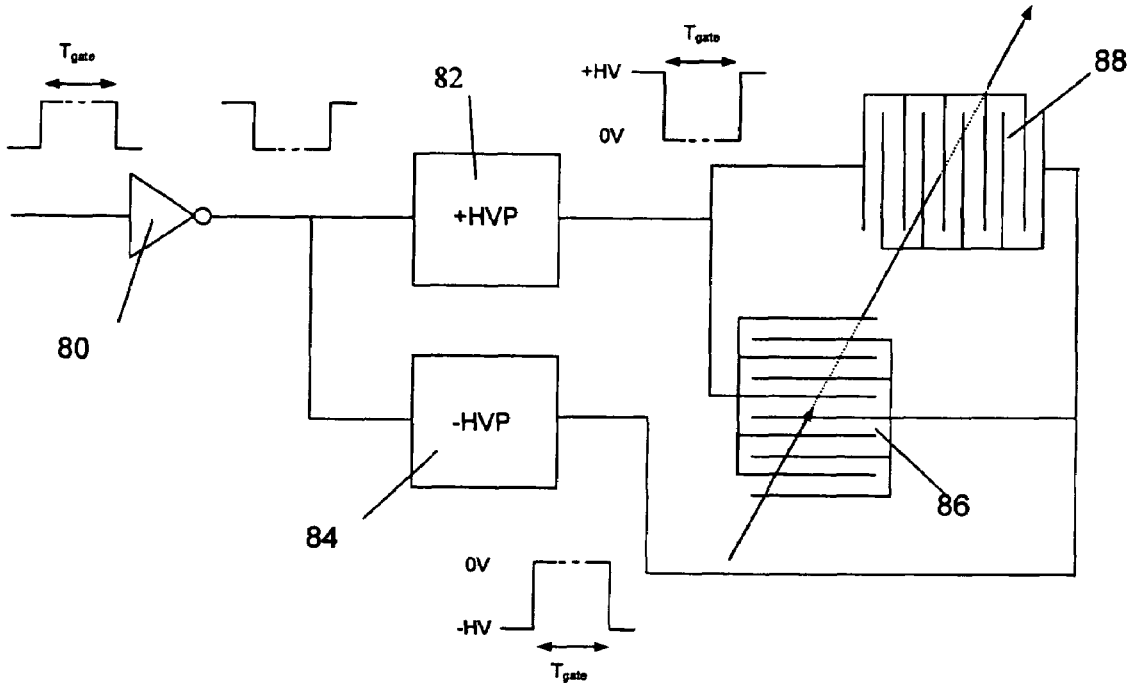

FIGS. 4*a* and 4*b* show a two-stage ion selector gate, being a second embodiment of the present invention;

FIG. 5 shows a switching circuit with "crossed" wire ion gates; and

Figure 6A:
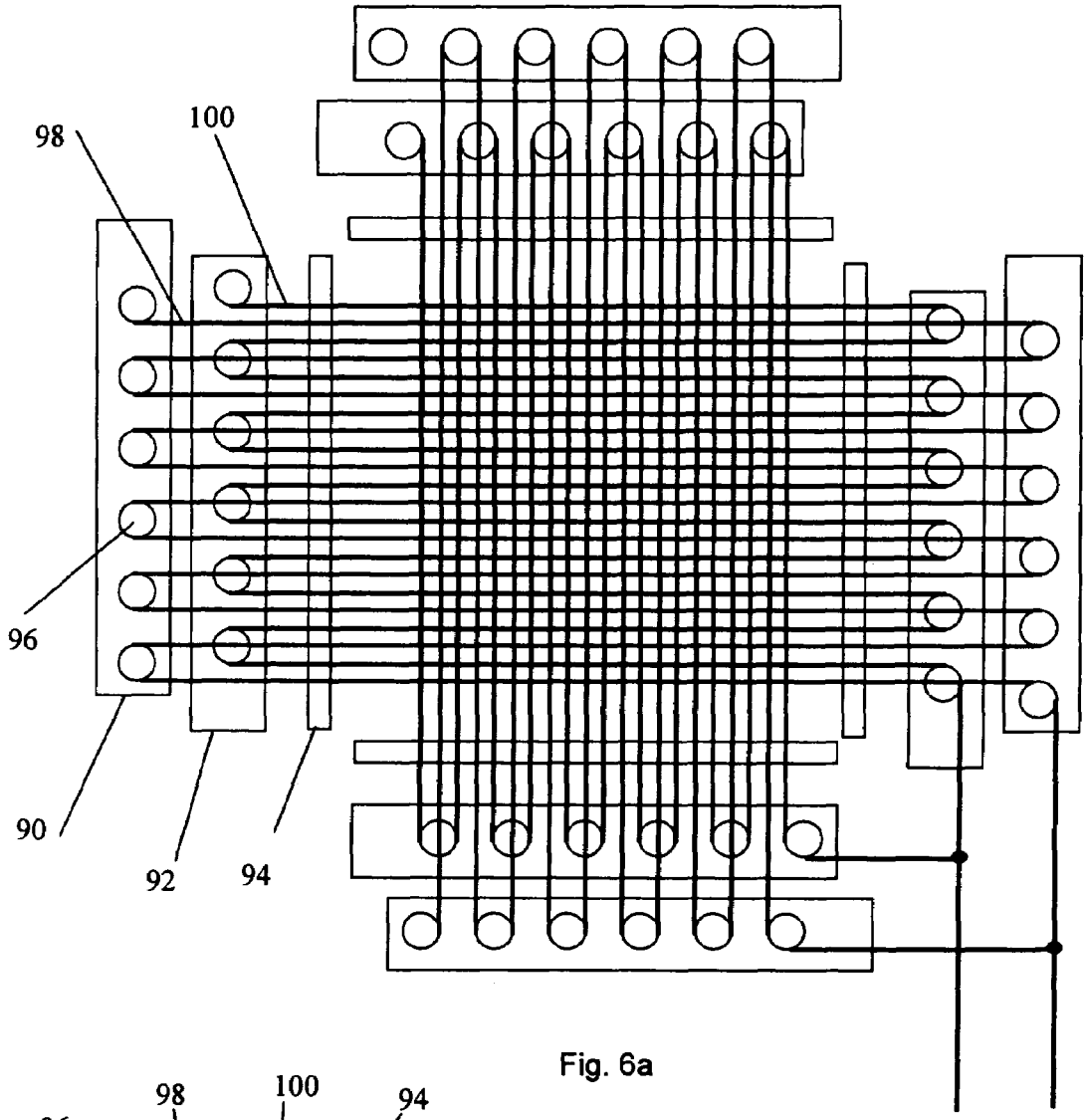
Figure 6B:
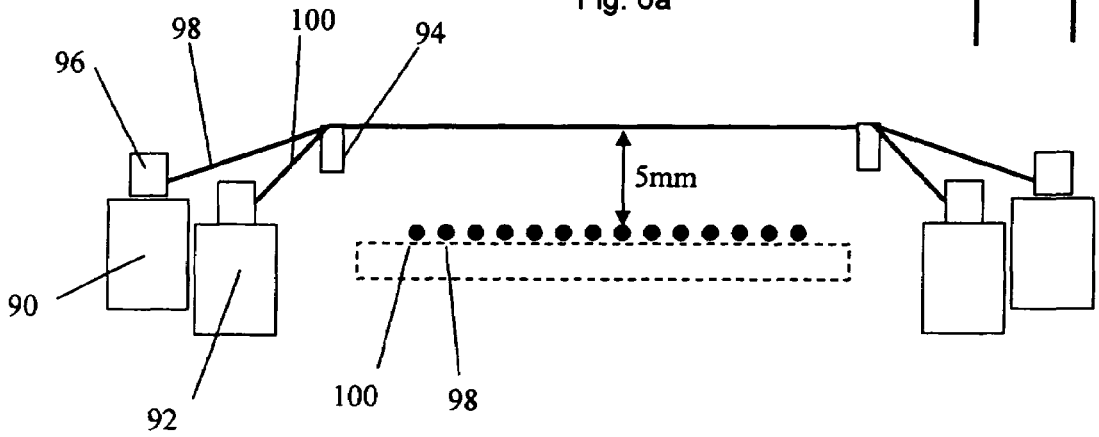

FIGS. 6*a* and 6*b* show a two-stage "crossed" wire ion selector gate, being a third embodiment of the present invention.

Figure 1A:
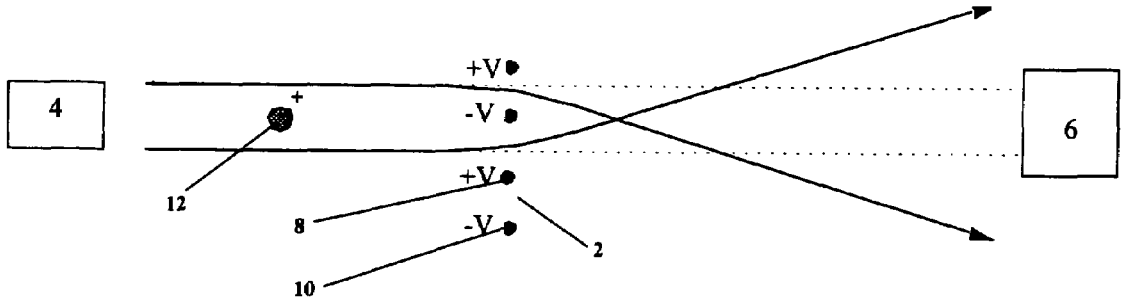
Figure 1B:
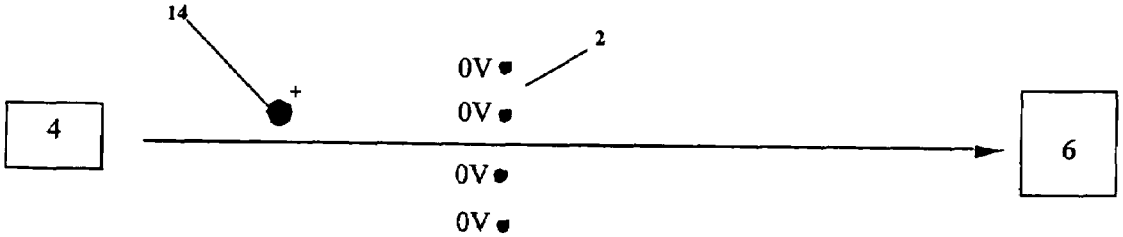
Figure 1C:
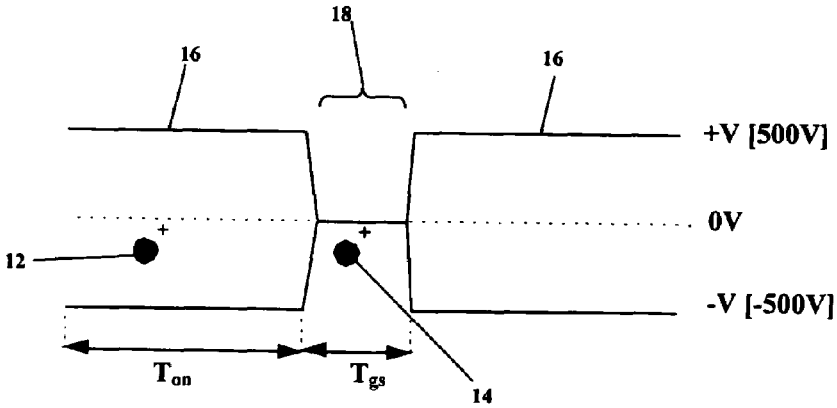

The prior art wire ion gate shown in FIG. 1 has already been described above, and the reference numerals used therein will be used to describe corresponding parts in the other Figures.

Figure 2:
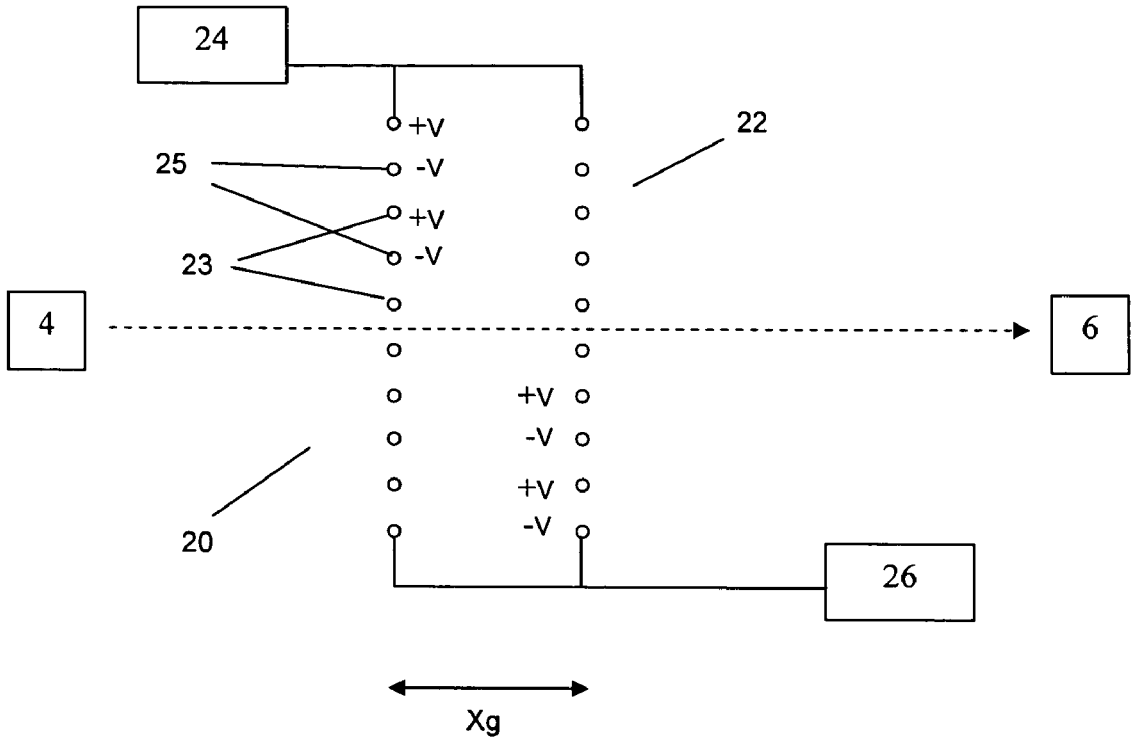
FIG. 2 shows a two-stage ion selector gate, being a first embodiment of the present invention.

FIG. 2 shows a two-stage wire ion selector gate according to the present invention being located in a mass spectrometer. The mass spectrometer has an ion source 4 and detector 6 and an ion flight path therebetween. The ion selector gate is located along the ion flight path.

The two-stage wire ion gate includes two wire ion gates 20, 22, each gate including a plurality of parallel wires, alternating wires 23, 25 being electrically insulated from one another. The spacing $X_g$ between the gates is, for example 1 to 10 mm, but preferably 2 to 5 mm.

The two-stage ion selector gate may, for example, include two gates of the type shown in FIG. 1. The two ion gates are preferably connected electrically such that, in use, a positive voltage, provided by a voltage supply 24, is applied to alternating wires 23 in each gate. Similarly, in use, a negative voltage, provided by voltage supply 26, is applied to alternating wires 25 in each gate.

The voltage applied to the two wire ion gates by voltage supplies 24 and 26 is, for example, about +500 V and −500 V respectively, but may be in the range 300 V to 1000 V, and −300 V to −1000 V, respectively.

This arrangement preferably provides high mass resolution. Suitably, this high mass resolution is achieved by using a relatively long switching pulse.

This means that the switching electronics can be simplified and the equipment needed is therefore cheaper and more reliable.

The relationship between mass resolution, the spacing of the gates and the pulsewidth of the switching pulse can be shown as follows:

As described before, the time for the gate pulse to be switched on is;

$$T_{on}=kL_gM^{1/2}$$

But for the 2-stage ion gate the off time is given by;

$$T_{off}=k(L_g+x_g)(M+\delta M)^{1/2}$$

Where $x_g$ is the spacing between the two ion gates. The gate pulse width $T_{gd}$ is now $$T_{gd}=kL_gM^{1/2}[(1+x_g/L_g)(1+\delta M/M)^{1/2}-1]$$

Again expanding for $\delta M/M<<1$;

$$T_{gd}=T_{on}(x_g/L_g+\delta M/M)$$

Because there is no change in velocity through the ion gate then, where the time taken for an ion of mass M to pass through the ion selector gate is $T_{xgd}$, it follows;

$$T_{xgd}/T_{on}=x_g/L_g$$

So that;

$$T_{gd}=T_{on}(T_{xgd}/T_{on}+\delta M/M)$$

And finally the resolution is;

$$M/\delta M=T_{on}/[2(T_{gd}-T_{xgd})]$$

So for the same mass resolution, $T_{gd}$ is larger than $T_{gs}$ by $T_{xgd}$. For a 1000 Da ion with 20 keV energy and a spacing between the gates of 3 mm, $T_{xgd}$ is about 50 ns. Hence to achieve the maximum theoretical mass selection resolution the minimum pulsewidth is 82 ns which is considerably more than the pulsewidth that would be required to achieve the same mass resolution with a single wire ion gate.

Figure 3:
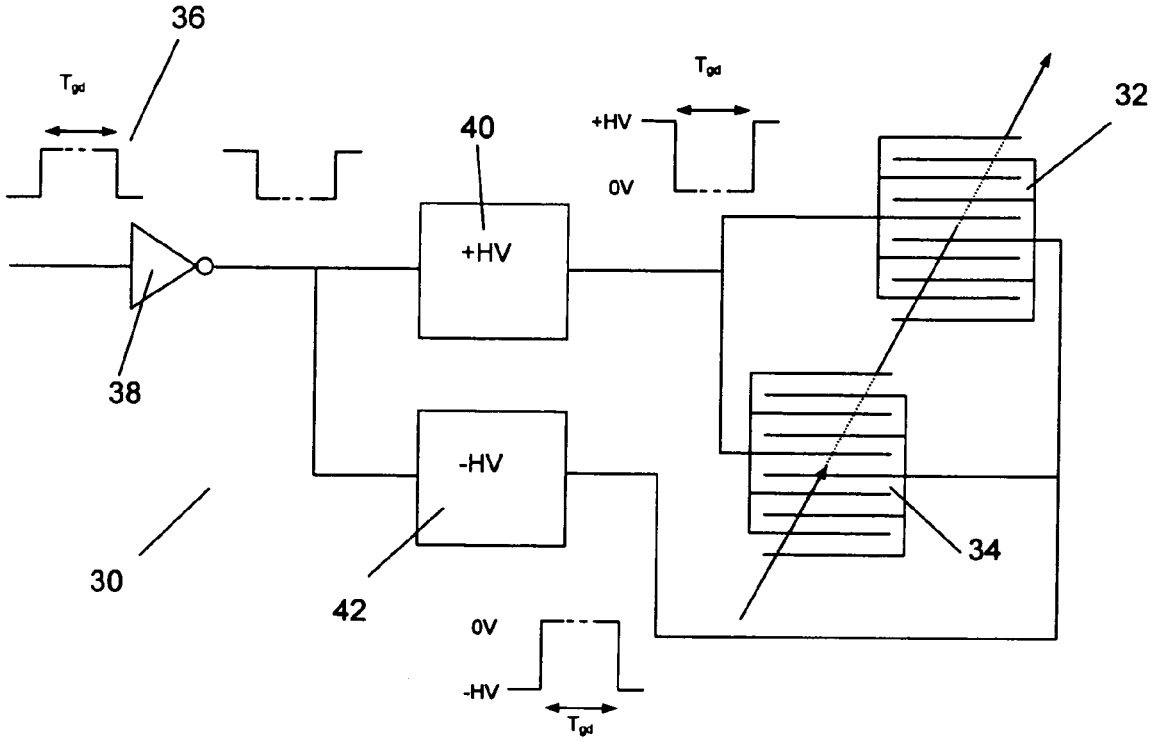
FIG. 3 shows a switching circuit.

FIG. 3 shows a switching circuit 30 for driving two wire ion gates 32, 34 in accordance with the present invention.

Typically, in use, a single low voltage trigger pulse is generated by timing electronics (not shown) with a width in time equal to or proportional to the width of the gate pulse $T_{gd}$ and at a position in time that the ion gate is required to be open to allow through ions of the correct nominal mass. This trigger pulse may go through an inverter, 38, and then to two high voltage (HV) pulsers 40 and 42. The high voltage pulsers each produce simultaneously a signal that switches to ground and back on again from the same amplitude high voltage but the opposite polarity. For example with $T_{gd}$ equal to 100 ns the pulser 40 will switch from +500 V to ground (in about 10 ns) and switch back to +500 V 100 ns later (also in about 10 ns). At the same time, the second pulser 42 will switch from −500 V to ground (in around 10 ns) and back to −500 V after a 100 ns delay.

The outputs of the HV pulsers are connected to interleaved wires of both ion gates 32, 34. Thus, the HV pulses are applied simultaneously to both ion gates. In alternative arrangements, the inverter 38 may not be required.

In some embodiments the trigger signal 36 may be split before the inverter 38. In other arrangements the HV pulsers 40, 42 may be a single bipolar unit or two separate units supplied with individual trigger signals.

In any case, the HV pulses are applied to the ion gates 32, 34 simultaneously and are similar or equal in amplitude but opposite in polarity. In the embodiment shown, each pulse is applied to both ion gates, for example connected in series or in parallel, such that the two ion gates 32, 34 are operated simultaneously.

FIGS. 4*a* and 4*b* show an ion selector gate 50 having two wire ion gates 52, 54 wherein some of the parallel wires of both gates are provided by a single length of wire.

FIG. 4*a* shows a front elevation view of the ion selector gate 50 and FIG. 4*b* shows a plan view.

This arrangement provides two Bradbury-Neilson type ion gates 52, 54 spaced apart by about 5 mm, although spacings of, for example, 2 mm to 10 mm may be used. In use, the ion selector gate is located in a mass spectrometer such that the ion beam axis 51 of the spectrometer passes through their centres.

The parallel wires 56, 58 have a diameter of 50 μm and a spacing of 500 μm. The wires are held accurately in position by three electrically insulating cylindrical posts 60, 62 and 64. These posts are preferably made from PEEK. The posts have a diameter of slightly more than 5 mm and have grooves in their outer cylindrical surface. The grooves have a vertical spacing of 0.5 mm, which therefore dictates the spacing of the wires, and sufficient depth that the adjacent wires are electrically isolated even when there is more than, for example, 1000 V potential difference between them.

In the embodiment shown there are only two individual wires, one of which 56 starts and ends on the conducting post 66 whilst the other 58 starts and ends on the conducting post 68. Preferably both posts are made from stainless steel, but may be made from any suitable metal or other conducting material. The two wires 56, 58 are wound on the conducting posts and the insulating posts so that they are interleaved. In use, a positive HV pulse is applied to one conducting post and a negative HV pulse applied to the other conducting post. In this way, adjacent wires have opposite electrical polarity.

Either or both of the conducting posts 66, 68 could be insulating provided the wires are continuous. Similarly, any of the posts 60, 62, 64 could be conducting provided electrical contact between the wire and post is avoided, for example by provision of insulation.

The conducting posts 66, 68 have pegs 70 extending from the posts such that the spacing between the pegs is accurate and equal. In this example the spacing is 1 mm. The pegs 70 are horizontally aligned with grooves in the insulating posts 60, 62 and 64. The pegs 70 in conducting posts 66 are offset vertically with respect to the pegs in conducting post 68 by an amount equal to half the spacing between the pegs. This is equal to the vertical spacing between the parallel wires so, in this example the offset is 0.5 mm.

The first individual wire 56 starts on conducting post 66 at the top from where it passes horizontally across insulating post 64 and to insulating post 62 where it goes round behind insulating post 62 back across insulating post 64 and back onto conducting post 66. On conducting post 66 the wire goes down to the next peg and repeats the path out to and round insulating post 62, but 1 mm lower. This is repeated until the lowest peg on conducting post 66 is reached. In this way the one individual wire forms two arrays of parallel wires where the wires in each array are separated by 1 mm.

The second individual wire 58 starts at the top of conducting post 68 from where it passes horizontally, without touching conducting post 66, over insulating posts 64 and 62 and onto insulating post 60. The wire passes through the grooves of insulating post 62 and 64 in between those occupied by the first wire 56. The second wire 58 continues round insulating post 60 and back over insulating posts 62 and 64 and onto conducting post 68 where it goes round the next lowest peg, 1 mm lower in height. The wire 58 goes back across insulating posts 64 and 62, round insulating post 60 and back to conducting post 68. This is repeated until the wire reaches the lowest peg on conducting post 68. In this way the second wire 58 forms two arrays of wires parallel to the arrays formed by the first wire 56 and interleaved with those arrays with a separation of 500 μm.

Finally, the electrical signal to control the ion selector gate is provided by connecting the two conducting posts 66 and 68 to respective positive and negative HV pulser circuits.

The following Example illustrates the advantages of the present invention.

The performance of an ion selector gate having two ion gates according to the present invention has been modelled using ion optical simulation and compared to that of a single wire ion gate of the prior art, under identical conditions. This was done using an ion optical model of a complete Maldi reflectron ToF MS in a commercial ion trajectory simulation package (SIMION 3D V7). In each case ions were extracted from the source with 20 keV energy and passed through the ion selector gate which had 10 thin wires with a spacing of 0.5 mm and an applied voltage of +500 V and −500 V on adjacent wires.

The double wire ion gate included two single wire ion gates arranged in series along the ion flight path, being spaced apart by 5 mm. The flight time for singly charged ions having a mass of 1050 Da to reach the ion gates was just over 7.4 μs and this was the value of the start time for opening the gate. The following tables show the variation of the mass range of ions passed by the gates as a function of the switching pulse width $T_{gd}$, along with the equivalent mass selection resolution for the ion selector gate.

TABLE 1

Variation of mass selection with pulse width for single B—N ion gate

| Pulse width (ns) | Mass range (Da) | Selection resolution |
|---|---|---|
| 20 | 1043-1044 | 500 |
| 30 | 1043-1047 | 200 |
| 40 | 1043-1050 | 150 |
| 50 | 1043-1053 | 100 |
| 60 | 1043-1056 | 75 |
| 70 | 1043-1059 | 65 |

TABLE 2

Variation of mass selection with pulse width for double B—N ion gate

| Pulse width (ns) | Mass range (Da) | Selection resolution |
|---|---|---|
| 100 | 1042-1043 | 500 |
| 110 | 1042-1046 | 200 |
| 120 | 1042-1048 | 150 |
| 130 | 1042-1051 | 100 |
| 140 | 1042-1054 | 80 |
| 150 | 1042-1057 | 65 |

For the single ion gate the minimum open width is 2 Da for a pulse width of 20 ns and gives an equivalent mass selection resolution of 500. At 70 ns pulse width, the mass window is 16 Da and the resolution is reduced to 65. In practice, an HV pulser on currently available instruments has a minimum pulse width of around 50 ns which means that the mass selection resolution is limited to about 100.

For the double wire ion gate of the present invention the minimum pulse width required to give a mass selection resolution of 500 is just 100 ns. The mass selection window increases with pulse width so that at 150 ns the gate allows through a 15 Da window equivalent to a resolution of 65. The mass selection range of the single and double ion gates therefore scale in the same way but with a difference in pulse width of 80 ns. This extra pulse width makes it possible to access the full mass selection resolution of the wire ion gate with existing HV pulse electronics.

FIG. 5 shows an electrical scheme for driving two ion gates as an example of the invention where the ion gates are "crossed" instead of parallel. In this embodiment the ion gates are "crossed" at about 90°. Other angles are possible, for example 70° to 90°, preferably 80° to 90°.

When the two ion gates are viewed from the point of view of an ion approaching the gates, the respective parallel wires of the first and second ion gates are crossed at right angles.

A single (low voltage) trigger pulse is generated by timing electronics in the instrument with a width in time equal to or proportional to the width Tgate and position in time that the ion gate is required to be open to allow through ions of the correct nominal mass. This trigger pulse goes through an inverter, 80, and then to two high voltage pulsers 82 and 84. The high voltage pulsers each produce a signal that switches to ground and back on again from the same amplitude high voltage but the opposite polarity. For example with Tgate equal to 100 ns the pulser 82 will switch from +500V to ground (in about 10 ns) and switch back to +500V 100 ns later again (also in about 10 ns). At the same time, the second pulser, 84 will switch from −500V to ground (in around 10 ns) and back to −500V after a 100 ns delay. The outputs of the HV pulsers are connected to interleaved wires of both ion gates 86 and 88. Thus the HV pulses are applied simultaneously to both ion gates.

In an embodiment the inverter and the two HV pulsers are contained in a single box and the HV pulsers are a single unit available commercially from DEI (Directed Energy Inc.,) in the USA. Depending on the specific design of HV pulser used, the inverter may or may not be required the trigger signal may be split before or after the inverter and the HV pulsers may be one bipolar unit or two separate units with individual triggers. However generated, the HV pulses are essentially simultaneous, equal (or similar) in amplitude but opposite in polarity. Each pulse is applied to both ion gates (connected in series or in parallel) such that the two ion gates operate simultaneously.

FIGS. 6*a* and 6*b* shows the basic structure of a double wire gate as could be used for the invention in the crossed configuration from the perspective of an ion as it approaches the ion gates and from above, perpendicular to the ion beam axis. It should be noted that the diagram is not to scale and may have more (or possibly less) wires than shown.

The design provides two Bradbury-Neilson type ion gates in series about 5 mm apart with the ion beam axis through their centres. The two ion gates are arranged so that the sets of wires in the second are at 90° to the first (i.e. crossed configuration). In this way the ions are deflected in one axis by the first gate and along an orthoganol axis by the second gate. The wires are 50 um diameter with a spacing of 500 um.

In one axis, the wires are held in position by the outer and inner supports, 90 and 92 (which can be electrically conductive or insulating). Electrically insulating grooved bars, 3 accurately locate and guide the wires. The grooves are very accurately machined to have a spacing of 0.5 mm (the spacing of the wires) and sufficient depth that the adjacent wires are electrically isolated even when there is more than 1000V potential difference between them. The grooved bars are raised up so that the wires passing over the inner supports from the outer supports do not touch the inner supports or the wires on them.

There are only two individual wires, one of which starts and ends on the outer supports, 90 whilst the other starts and ends on the inner supports, 92. The two wires are wound around the pegs, 96 so that they are interleaved. A positive HV pulse is applied to one metal post whilst the negative HV pulse applied to the other and in this way, adjacent wires have opposite electrical polarity. The pegs, 96 are fitted so that the spacing between them is accurate and equal, in this example 1 mm. The pegs are horizontally in line with grooves in the grooved bars, 94. The pegs in the outer supports are offset with respect to the pegs in the inner supports by an amount equal to half the spacing between the pegs. This is equal to the spacing between wires so, in this example the offset is 0.5 mm. One of the two individual wires starts on the inner support at the top from where it passes horizontally across the grooved bar, 94 and across to the other inner support where it goes round a peg and back across the grooved bar and back to the other inner support. Here the wire goes around the next peg and the path is repeated but 1 mm lower until the lowest peg is reached. In this way the one individual wire forms a grid of parallel wires where the wires are separated by 1 mm. The second individual wire starts at the top of the outer support from where it across the grooved bar 94 and across to the other outer support. The wire goes in the grooves of the bar, 94 in between those occupied by the first wire. The second wire goes round the peg 96 and back over the grooved bar 94 and onto the first outer support where it goes round a peg down in height (by 1 mm). This is repeated until the wire reaches the lowest peg on the outer support. In this way the second wire forms a grids of wires parallel to the set formed by the first wire and interleaved at half the spacing i.e., 0.5 mm (or 500 um). Finally, the electrical signal to control the double ion gate is provided by connecting one wire from each polarity HV pulser circuit to one of the outer and one of the inner supports, 90 and 92 respectively.

The second axis is essentially identical to the first but it is rotated through 90° and offset by about 5 mm along the ion optical axis. The wires are connected to the HV pulser circuit in the same way so that the one polarity goes to the wire(s) on the inner support and the other to those on the outer support.

The above embodiments are given by way of example only and variations will be apparent to those skilled in the art.

The invention claimed is:

1. A method of ion selection in a time of flight mass spectrometer having an ion source, a detector, and an ion selector gate having first and second ion deflection zones located in series along an ion flight path between the ion source and the detector, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, the method including the step of simultaneously applying a switching pulse to both ion deflection zones, to open or close both deflection zones simultaneously, wherein when a deflection zone is closed it deflects ions so that they do not reach the detector.

2. A method according to claim 1, wherein the method includes the steps of setting both deflection zones to a closed state and simultaneously applying a switching pulse to both deflection zones to open and then close them.

3. A method according to claim 1, wherein the method includes the step of applying the same switching pulse to both deflection zones.

4. A method according to claim 1, wherein the length of the switching pulse applied to the deflection zones is about 80 ns to 200 ns.

5. A method according to claim 1, wherein the first and second deflection zones are provided by two discrete ion gates.

6. A method according to claim 5, wherein the two discrete ion gates are spaced apart by about 1 to 10 mm.

7. A method according to claim 5, wherein the discrete ion gates are wire ion gates.

8. A method according to claim 7, wherein the wire ion gates have an array of parallel wires, each wire having a diameter of about 10 μm to 100 μm.

9. A method according to claim 8, wherein the spacing between the wires is about 200 μm to 1000 μm.

10. A method according to claim 5, wherein the two discrete ion gates are arranged to provide orthogonal deflection fields in use.

11. An ion selector apparatus for use in a time of flight mass spectrometer having an ion source and a detector, the ion selector apparatus having a first deflection zone, a second deflection zone, and a control means, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, wherein in use the first and second deflection zones are located between the ion source and the detector, and the first and second deflection zones are simultaneously switchable by the control means between a closed state, in which each deflection zone deflects ions so that they are not detected and an open state in which ions can pass through the deflection zones to the detector.

12. An ion selector apparatus according to claim 11, wherein the two deflection zones are simultaneously switchable by the control means from a closed state to an open state and then back to a closed state.

13. An ion selector apparatus according to claim 11, wherein the control means includes a switching circuit for simultaneously applying a switching pulse to both deflector zones.

14. An ion selector apparatus according to claim 12, wherein the switching circuit is capable of providing a switching pulse having a pulse width of about 30 ns to 500 ns.

15. An ion selector apparatus according to claim 11, wherein the first and second deflection zones are provided by two discrete ion gates.

16. An ion selector apparatus according to claim 15, wherein the two discrete ion gates are spaced apart by about 1 to 10 mm.

17. An ion selector apparatus according to claim 15, wherein the discrete ion gates are wire ion gates.

18. An ion selector apparatus according to claim 17, wherein the wire ion gates have an array of parallel wires, each wire having a diameter of about 10 μm to 100 μm.

19. An ion selector apparatus according to claim 18, wherein the spacing between the wires is about 200 μm to 1000 μm.

20. An ion selector apparatus according to claim 15, wherein the two discrete ion gates are arranged at right angles to each other to provide orthogonal deflection fields in use.

21. An ion selector gate having a first deflection zone and a second deflection zone spaced from the first deflection zone, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, wherein the first and second deflection zones are electrically connected such that a voltage applied to the first deflection zone is also applied to the second deflection zone.

22. An ion selector gate according to claim 21, wherein a single wire provides alternate parallel wires in the first wire ion gate and alternate wires in the second wire ion gate.

23. An ion selector gate according to claim 21, wherein alternate parallel wires of the first wire ion gate and alternate parallel wires of the second wire ion gate are connected to a first conducting post.

24. An ion selector gate according to claim 21, wherein the parallel wires of the first wire ion gate are orthogonal to the parallel wires of the second wire ion gate.

25. A time of flight mass spectrometer including an ion source, a detector, and an ion selector apparatus, said ion selector apparatus having a first deflection zone, a second deflection zone, and control means, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, wherein in use the first and second deflection zones are located between the ion source and the detector, and the first and second deflection zones are simultaneously switchable by the control means between a closed state, in which each deflection zone deflects ions so that they are not detected and an open state in which ions can pass through the deflection zones to the detector.

26. A time of flight mass spectrometer including an ion selector gate, said ion selector gate having a first deflection zone and a second deflection zone spaced from the first deflection zone, wherein the first and second deflection zones are electrically connected such that a voltage applied to the first deflection zone is also applied to the second deflection zone.

27. A time of flight mass spectrometer according to claim 25, wherein the time of flight mass spectrometer has an ion source and a detector and an ion flight path therebetween and the two deflection zones of the ion selector apparatus are located in series between the ion source and detector, along the ion flight path.

28. A time of flight mass spectrometer according to claim 27, wherein the time of flight mass spectrometer is a TOF mass spectrometer.

29. A time of flight mass spectrometer according to claim 28, wherein the time of flight mass spectrometer is a TOF MS/MS spectrometer.

30. A time of flight mass spectrometer according to claim 29, wherein the time of flight mass spectrometer includes a reflectron and the deflection zones of the ion selector apparatus are located between the ion source and the reflectron.

31. A time of flight mass spectrometer according to claim 26, wherein the time of flight mass spectrometer has an ion source and a detector and an ion flight path therebetween and the two deflection zones of the ion selector apparatus are located in series between the ion source and detector, along the ion flight path.

32. A method of ion selection in a time of flight mass spectrometer having an ion source, a detector, and an ion selector gate having first and second ion deflection zones located in series along an ion flight path between the ion source and the detector, the method including the step of simultaneously applying a switching pulse to both ion deflection zones, to open or close both deflection zones simultaneously, wherein when a deflection zone is closed it deflections ions so that they do not reach the detector, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, wherein the two wire ion gates are spaced apart by about 1 to 10 mm.

33. A method of ion selection in a time of flight mass spectrometer having an ion source, a detector, and an ion selector gate having first and second ion deflection zones located in series along an ion flight path between the ion source and the detector, the method including the step of simultaneously applying a switching pulse to both ion deflection zones, to open or close both deflection zones simultaneously, wherein when a deflection zone is closed it deflections ions so that they do not reach the detector, wherein the firs and second defection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate, wherein the two wire ion gates are arranged to provide orthogonal deflection fields in use.

34. An ion selector gate having a first deflection zone and a second deflection zone spaced from the first deflection zone, wherein the first and second deflection zones are electrically connected such that a voltage applied to the first deflection zone is also applied to the second deflection zone, wherein the first and second deflection zones are provided by a first wire ion gate and a second wire ion gate respectively, each gate having a plurality of parallel wires, wherein at least one of the parallel wires in the first wire ion gate extends from the first wire ion gate to the second wire ion gate to form at least one of the parallel wires in the second wire ion gate.

* * * * *